US012790785B2

(12) United States Patent
Ikeda et al.

(10) Patent No.: US 12,790,785 B2
(45) Date of Patent: Nov. 10, 2026

(54) CONTROL SYSTEM, CONTROL METHOD, AND WORK MACHINE

(71) Applicant: KOMATSU LTD., Tokyo (JP)

(72) Inventors: Hiroaki Ikeda, Tokyo (JP); Shinichi Kitao, Tokyo (JP)

(73) Assignee: KOMATSU LTD., Tokyo (JP)

( * ) Notice: Subject to any disclaimer, the term of this patent is extended or adjusted under 35 U.S.C. 154(b) by 183 days.

(21) Appl. No.: 18/559,217

(22) PCT Filed: May 27, 2022

(86) PCT No.: PCT/JP2022/021712
§ 371 (c)(1),
(2) Date: Nov. 6, 2023

(87) PCT Pub. No.: WO2022/255240
PCT Pub. Date: Dec. 8, 2022

(65) Prior Publication Data

US 2024/0247460 A1 Jul. 25, 2024

(30) Foreign Application Priority Data

May 31, 2021 (JP) ..... 2021-091215

(51) Int. Cl.

| | |
|---|---|
| ***E02F 3/43*** | (2006.01) |
| ***E02F 3/28*** | (2006.01) |
| ***E02F 9/20*** | (2006.01) |
| ***E02F 9/22*** | (2006.01) |

(52) U.S. Cl.
CPC ..... *E02F 3/431* (2013.01); *E02F 9/2004* (2013.01); *E02F 3/283* (2013.01); *E02F 9/2203* (2013.01)

(58) Field of Classification Search
CPC ..... E02F 3/431; E02F 9/2004; E02F 3/283; E02F 9/2203
See application file for complete search history.

(56) References Cited

U.S. PATENT DOCUMENTS

| | | | | |
|---|---|---|---|---|
| 5,467,829 | A | 11/1995 | Barton et al. | |
| 6,371,214 | B1 | 4/2002 | Anwar et al. | |
| 2008/0263909 | A1 * | 10/2008 | Schoenmaker | E02F 9/264 711/100 |

(Continued)

FOREIGN PATENT DOCUMENTS

| | | | |
|---|---|---|---|
| JP | 1-97726 | A | 4/1989 |
| JP | 1-111926 | A | 4/1989 |

(Continued)

*Primary Examiner* — Hitesh Patel
*Assistant Examiner* — Joshua Jeffrey Penko
(74) *Attorney, Agent, or Firm* — Spencer Fane LLP

(57) ABSTRACT

A work machine includes a work device having a work tool and a movable support section configured to change an orientation of the work tool. A control system of the work machine includes a controller including a storage unit configured to store at least three types of target orientations including a first orientation. The controller is configured to select any one of the at least three types of target orientations based on a command signal for operating the orientation of the work tool and a detection signal indicating a current orientation of the work tool, and set the selected target orientation as a target orientation of the work tool to control the movable support section.

7 Claims, 13 Drawing Sheets

(56) References Cited

U.S. PATENT DOCUMENTS

| | | | | |
|---|---|---|---|---|
| 2019/0382984 | A1* | 12/2019 | Hagiwara | E02F 9/202 |
| 2021/0285182 | A1 | 9/2021 | Oasa et al. | |
| 2022/0081871 | A1 | 3/2022 | Oasa | |

FOREIGN PATENT DOCUMENTS

| | | | | |
|---|---|---|---|---|
| JP | 5-9952 | A | | 1/1993 |
| JP | 10-54056 | A | | 2/1998 |
| JP | 11-107323 | A | | 4/1999 |
| JP | 2004-36327 | A | | 2/2004 |
| JP | 2013-167098 | A | | 8/2013 |
| JP | 2013-167099 | A | | 8/2013 |
| JP | 2016098520 | A | * | 5/2016 |
| JP | 2020-169508 | A | | 10/2020 |
| JP | 2021-11819 | A | | 2/2021 |

* cited by examiner

CONTROL SYSTEM, CONTROL METHOD, AND WORK MACHINE

CROSS-REFERENCE TO RELATED APPLICATIONS

This application is a U.S. National stage application of International Application No. PCT/JP2022/021712, filed on May 27, 2022. This U.S. National stage application claims priority under 35 U.S.C. § 119(a) to Japanese Patent Application No. 2021-091215, filed in Japan on May 31, 2021, the entire contents of which are hereby incorporated herein by reference.

BACKGROUND

Field of the Invention

The present disclosure relates to a control system, a control method, and a work machine.

Background Information

Japanese Unexamined Patent Application, First Publication No. 2013-167098 discloses a wheel loader that automatically adjusts a bucket to a horizontal orientation in a case in which an operation lever is operated to a holding position.

SUMMARY

In the wheel loader as an example of the work machine, for example, as a typical orientation often used in the bucket, which is an example of a work tool, there are a transport orientation, a dumping orientation, a ground contact orientation, and the like, in addition to a horizontal orientation. However, the wheel loader described in Japanese Unexamined Patent Application, First Publication No. 2013-167098 has a problem in that the orientation of the bucket cannot be automatically adjusted to a plurality of typical orientations.

The present disclosure has been made in view of the above-described circumstances, and an object of the present disclosure is to provide a control system, a control method, and a work machine that can automatically adjust an orientation of a work tool to a plurality of orientations.

In order to achieve the aforementioned objects, a first aspect of the present disclosure is a control system of a work machine including a work device including a work tool and a movable support section configured to change an orientation of the work tool, the control system includes a controller including a storage unit configured to store at least three types of target orientations. The controller is configured to select any one of the at least three types of target orientations based on a command signal for operating the orientation of the work tool and a detection signal indicating a current orientation of the work tool, and set the selected target orientation as a target orientation of the work tool to control the movable support section.

In addition, a second aspect of the present disclosure is a control system of a work machine including a work device including a work tool and a movable support section configured to change an orientation of the work tool, the control system includes a controller including a storage unit configured to store at least three types of target orientations including a first orientation. The controller is configured to, in a case in which a command signal for operating the orientation of the work tool is received, control the movable support section by using the first orientation as a target orientation of the work tool. The controller is configured to, in a case in which the command signal is continuously and repeatedly received within a predetermined time, select a target orientation different from the first orientation among the at least three types of target orientations, and set the selected target orientation as the target orientation of the work tool to control the movable support section.

In addition, a third aspect of the present disclosure is a control method of a work machine including a work device including a work tool and a movable support section configured to change an orientation of the work tool, the control method including the following steps. In a first step, at least three types of target orientations are stored. In a second step, any one of the at least three types of target orientations is selected based on a command signal for operating the orientation of the work tool and a detection signal indicating a current orientation of the work tool. In a third step, the selected target orientation is set as the target orientation of the work tool to control the movable support section.

In addition, a fourth aspect of the present disclosure is a control method of a work machine including a work device including a work tool and a movable support section configured to change an orientation of the work tool, the control method including the following steps. In a first step, at least three types of target orientations including a first orientation are stored. In a second step, in a case in which a command signal for operating the orientation of the work tool is received, the first orientation as a target orientation is selected. In a third step, in a case in which the command signal is continuously and repeatedly received within a predetermined time, a target orientation different from the first orientation among the at least three types of target orientations is selected. In a fourth step, the selected target orientation is set as the target orientation of the work tool to control the movable support section.

In addition, a fifth aspect of the present disclosure is a work machine including a work tool, a movable support section configured to change an orientation of the work tool, and a controller configured to control the movable support section. The controller includes a storage unit configured to store at least three types of target orientations. The controller is configured to select any one of the at least three types of target orientations based on a command signal for operating the orientation of the work tool and a detection signal indicating a current orientation of the work tool, and set the selected target orientation as a target orientation of the work tool to control the movable support section.

In addition, a sixth aspect of the present disclosure is a work machine including a work tool, a movable support section configured to change an orientation of the work tool, and a controller configured to control the movable support section. The controller includes a storage unit configured to store at least three types of target orientations including a first orientation. The controller is configured to, in a case in which a command signal for operating the orientation of the work tool is received, control the movable support section by using the first orientation as a target orientation of the work tool. The controller is configured to, in a case in which the command signal is continuously and repeatedly received within a predetermined time, select a target orientation different from the first orientation among the at least three types of target orientations, and set the selected target orientation as the target orientation of the work tool to control the movable support section.

According to each of the aspects of the present disclosure, it is possible to automatically adjust the orientation of the work tool to the plurality of orientations.

DETAILED DESCRIPTION OF EMBODIMENT(S)

Figure 1:
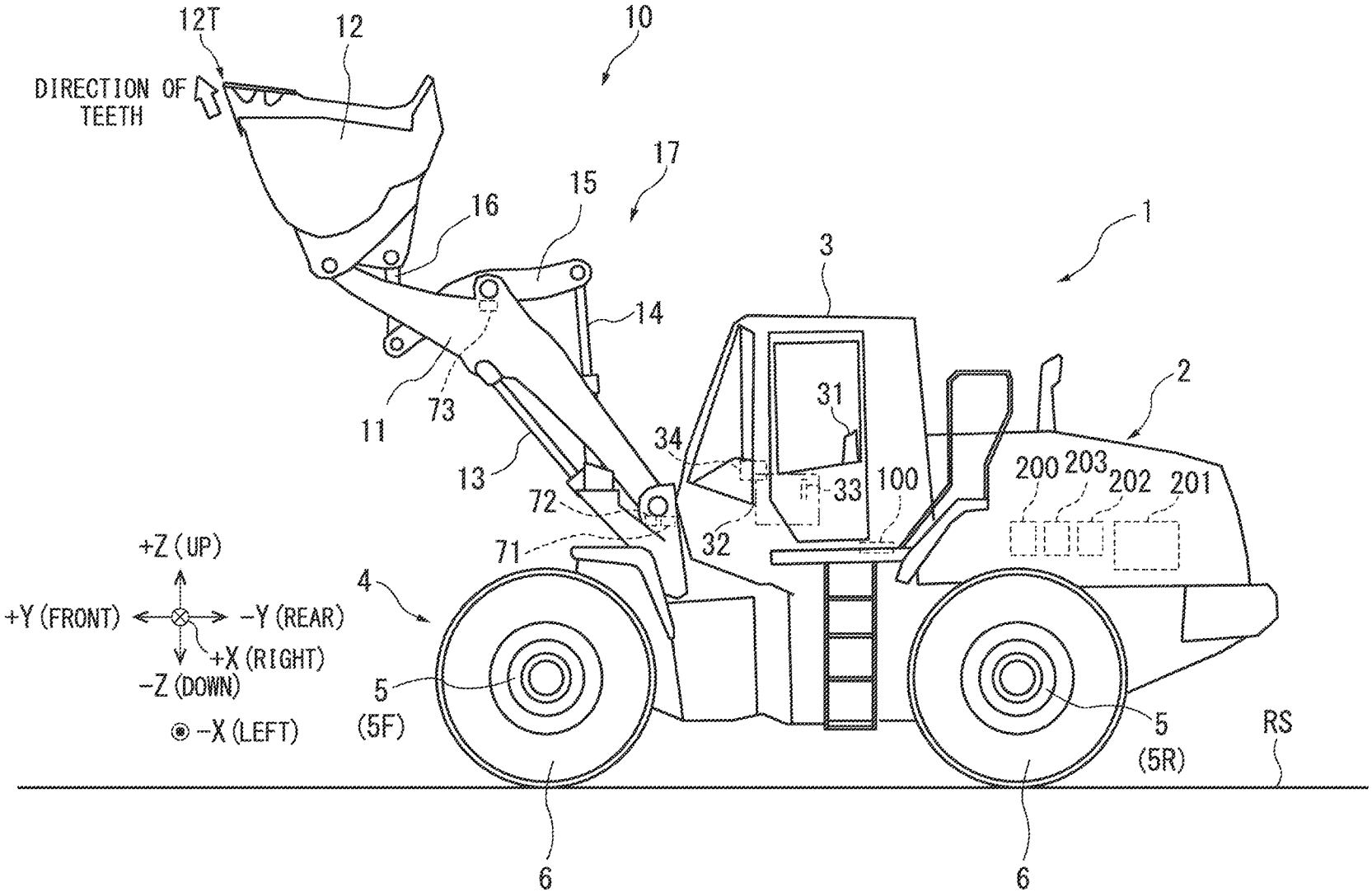
FIG. 1 is a side view showing a work machine according to a first embodiment.

Hereinafter, embodiments according to the present disclosure will be described with reference to the drawings. It should be noted that, in each drawing, the same reference numerals are used for the same or corresponding configurations, and the description thereof will be omitted as appropriate.

In the present embodiment, a local coordinate system is set in a work machine 1, and a positional relationship of each of units will be described with reference to the local coordinate system. In the local coordinate system, a first axis extending in a right-left direction (vehicle width direction) of the work machine 1 will be defined as an X-axis, a second axis extending in a front-rear direction of the work machine 1 will be defined as a Y-axis, and a third axis extending in an up-down direction of the work machine 1 will be defined as a Z-axis. The X-axis and the Y-axis are orthogonal to each other. The Y-axis and the Z-axis are orthogonal to each other. The Z-axis and the X-axis are orthogonal to each other. A +X-direction is the right direction, and a −X-direction is the left direction. A +Y-direction is the front direction, and a −Y-direction is the rear direction. A +Z-direction is the up direction, and a −Z-direction is the down direction.

First Embodiment (Overview of Work Machine)

FIGS. 1 to 5 are side views showing the work machine 1 according to the first embodiment. For example, the work machine 1 according to the first embodiment is a wheel loader. Hereinafter, the work machine 1 will be referred to as a wheel loader 1 as appropriate.

As shown in FIG. 1, the wheel loader 1 has a vehicle body 2, a cab 3, a traveling device 4, and a work device 10. The wheel loader 1 travels a work place by using the traveling device 4. In the work place, the wheel loader 1 carries out work by using the work device 10. The wheel loader 1 can use the work device 10 to carry out the work, such as excavation work, loading work, transport work, and snow removal work.

The cab 3 is supported by the vehicle body 2. Inside the cab 3, a driver's seat 31 on which an operator sits, an operation device 32 to be described below, and a display input unit 34 are disposed.

The traveling device 4 has rotatable wheels 5. The wheels 5 support the vehicle body 2. The wheel loader 1 can travel on a road surface (or ground) RS by the traveling device 4. It should be noted that FIG. 1 shows only a front wheel 5F and a rear wheel 5R on a left side.

The work device 10 is supported by vehicle body 2. The work device 10 is configured by a bucket 12 as an example of a work tool, and a movable support section 17 that changes a position and an orientation of the bucket 12. In the example shown in FIG. 1, the movable support section 17 includes a boom 11, a boom cylinder 13, a bucket cylinder 14, a bell crank 15, and a link 16.

The boom 11 is supported by the vehicle body 2 to be rotationally movable, and moves in the up-down direction according to expansion and contraction of the boom cylinder 13, as shown in FIGS. 1 to 5. The boom cylinder 13 is an actuator that generates power for moving the boom 11, and has one end portion connected to the vehicle body 2 and the other end portion connected to the boom 11. In a case in which the operator operates a boom operation device (not shown) included in the operation device 32, the boom cylinder 13 expands and contracts. As a result, the boom 11 moves in the up-down direction. The boom cylinder 13 is, for example, a hydraulic cylinder.

The bucket 12 has teeth 12T and is a work tool for excavating and loading an excavation object, such as earth. The bucket 12 is connected to the boom 11 to be rotationally movable, and is connected to one end portion of the link 16 to be rotationally movable. The other end portion of the link 16 is connected to one end portion of the bell crank 15 to be rotationally movable. The bell crank 15 has a central portion connected to the boom 11 to be rotationally movable, and the other end portion connected to one end portion of the bucket cylinder 14 to be rotationally movable. The other end portion of the bucket cylinder 14 is connected to the vehicle body 2 to be rotationally movable. The bucket 12 is operated by power generated by the bucket cylinder 14. The bucket cylinder 14 is an actuator that generates power for moving the bucket 12. In a case in which the operator operates the bucket operation device 33, the bucket cylinder 14 expands and contracts. As a result, the bucket 12 swings. The bucket cylinder 14 is, for example, a hydraulic cylinder. The teeth 12T has a shape of chevron teeth, flat teeth, or the like, and is attached to an end portion of the bucket 12 to be replaceable.

Figure 2:
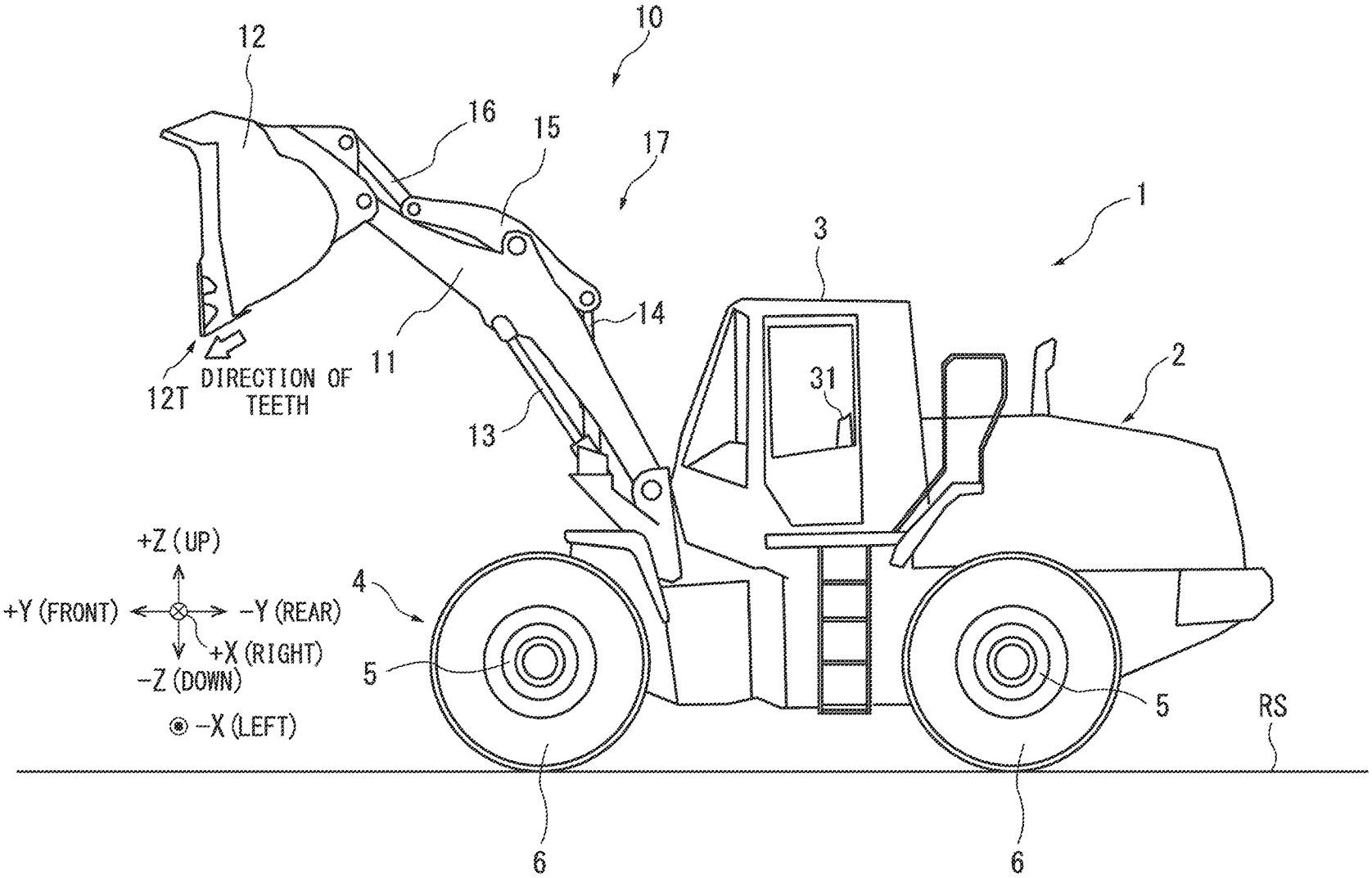
FIG. 2 is a side view showing an operation example of the work machine according to the first embodiment.
Figure 3:
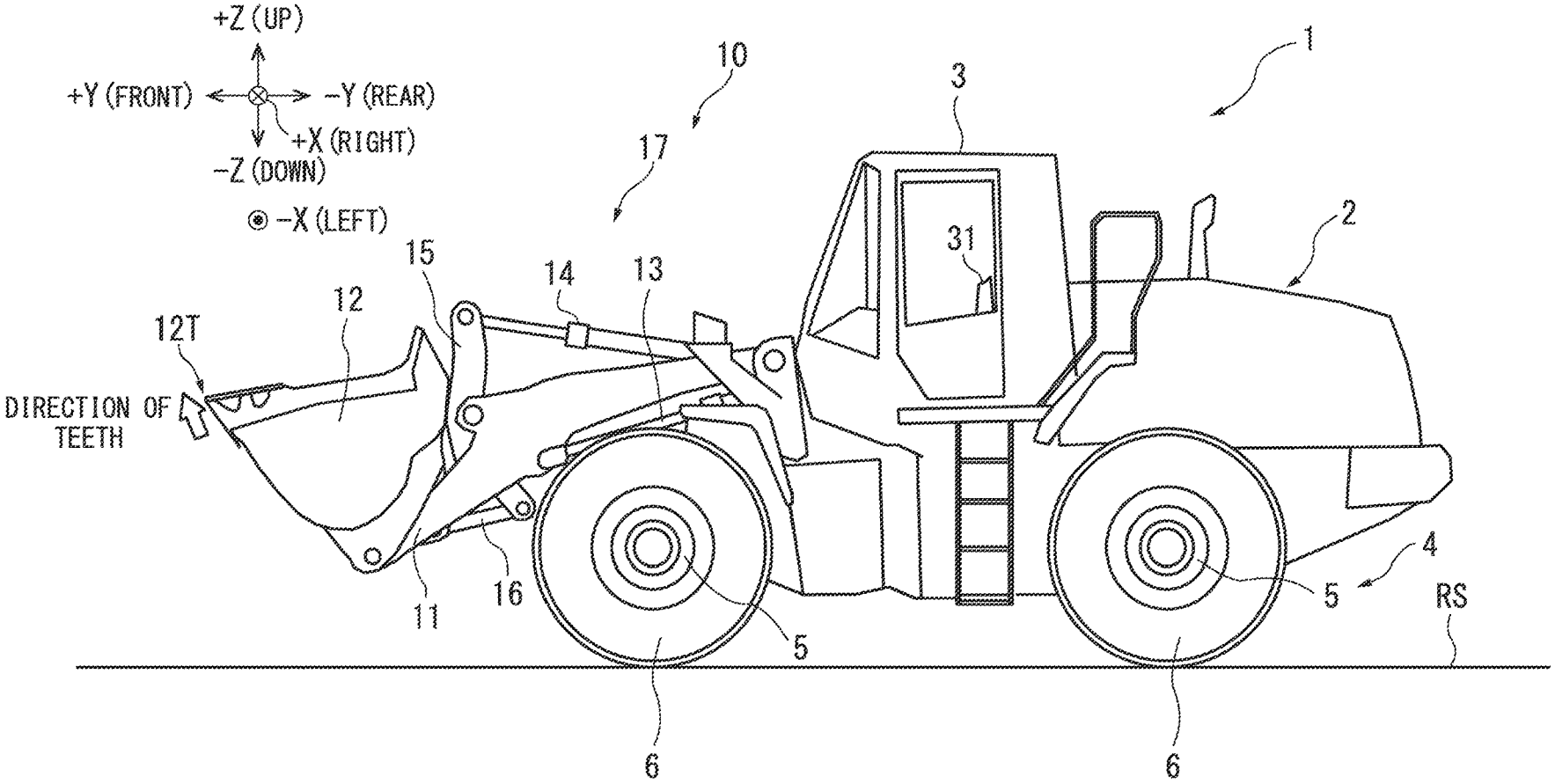
FIG. 3 is a side view showing another operation example of the work machine according to the first embodiment.
Figure 4:
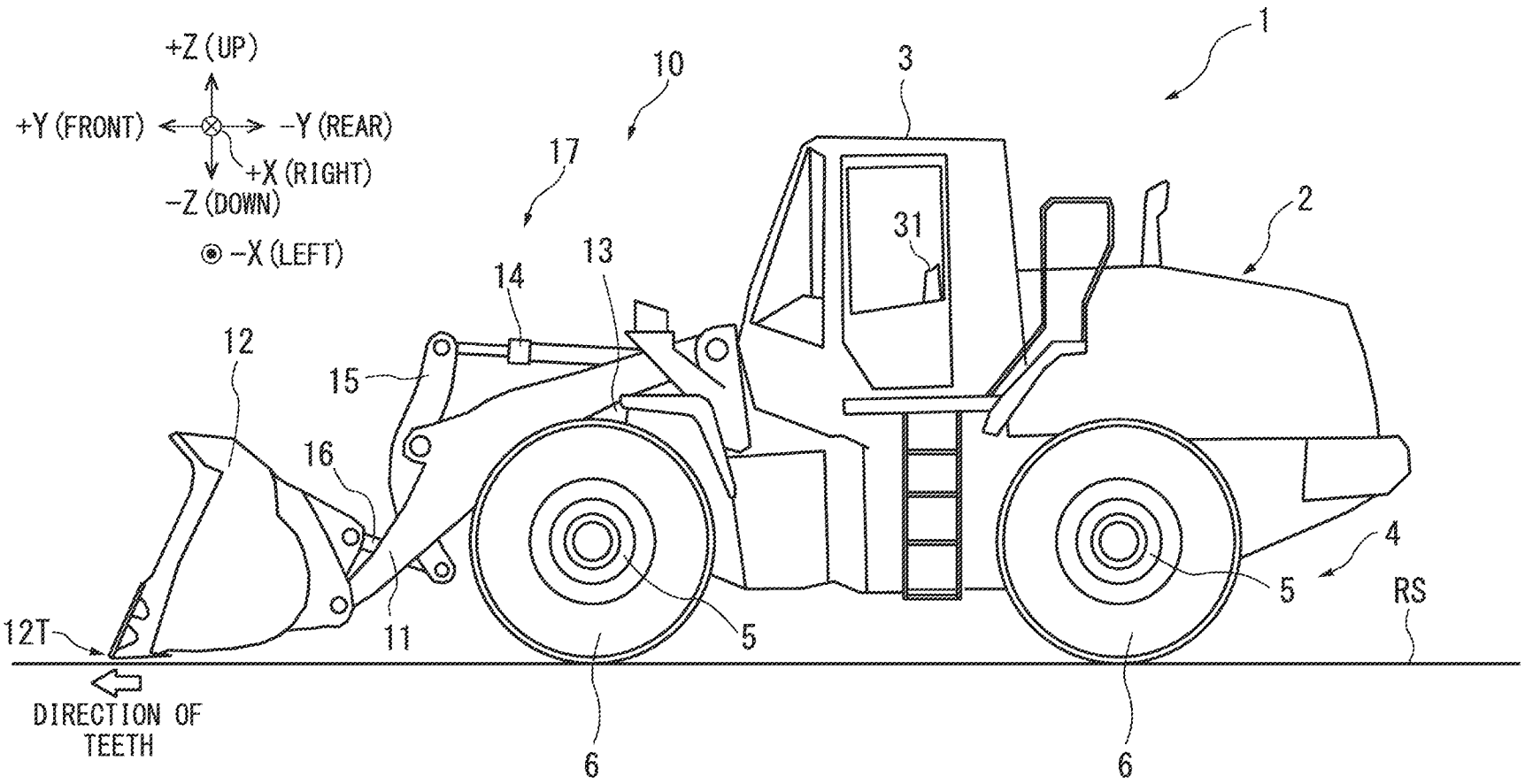
FIG. 4 is a side view showing still another operation example of the work machine according to the first embodiment.
Figure 5:
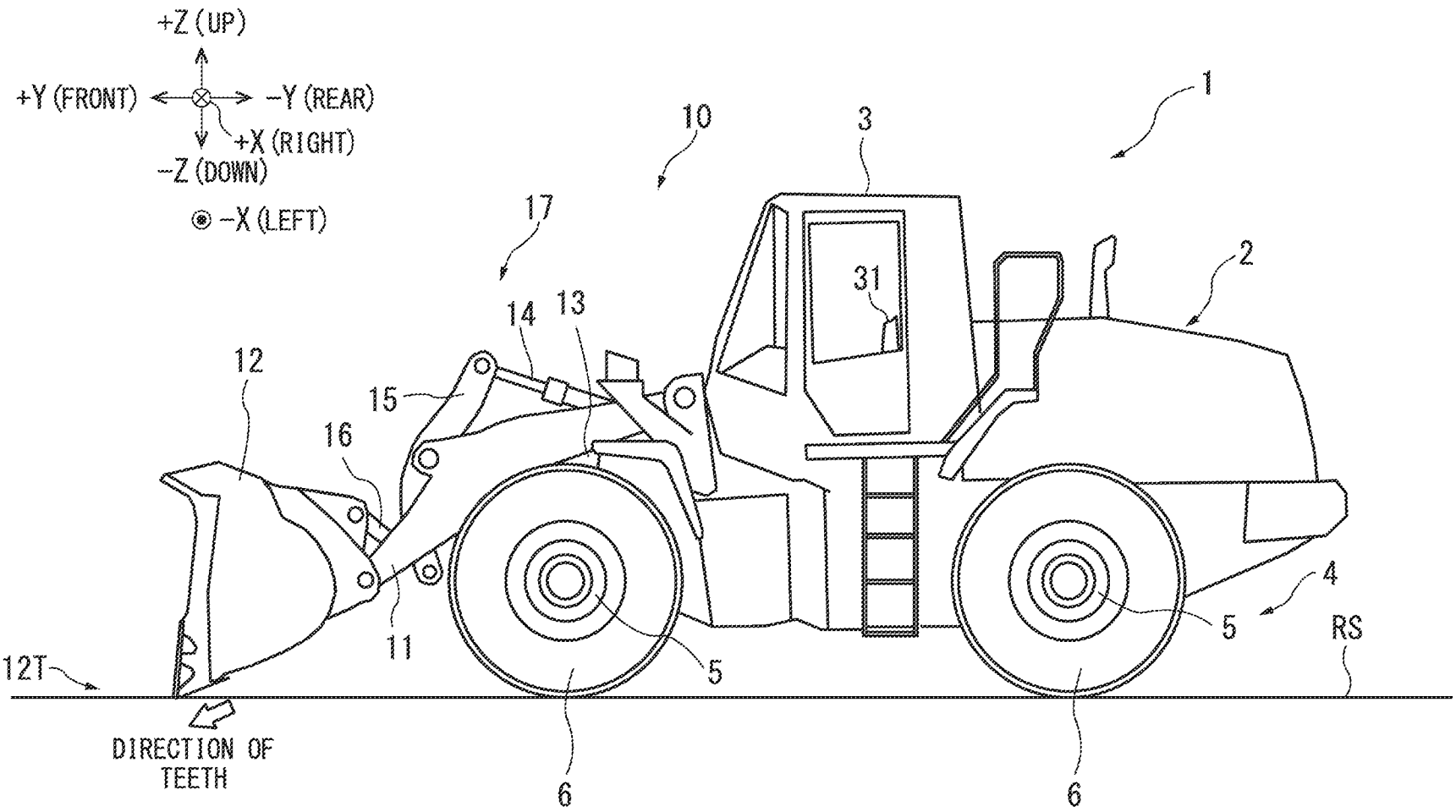
FIG. 5 is a side view showing still another operation example of the work machine according to the first embodiment.

It should be noted that, in the present embodiment, an orientation of the bucket 12 with the teeth 12T facing downward as shown in FIG. 2 is referred to as a dump orientation. The dump orientation is, for example, an orientation in which an excavation material in the bucket 12 can be loaded onto a transport vehicle or the like (dumping orientation). In addition, an orientation of the bucket 12 with the teeth 12T facing upward as shown in FIG. 3 is referred to as a tilt orientation (holding orientation). The tilt orientation is, for example, an orientation in which the excavation material can be held in the bucket 12 (transport orientation). In addition, an orientation of the bucket 12 with the teeth 12T facing a direction horizontal to the road surface RS (including a substantially horizontal direction) as shown in FIG. 4 is referred to as an excavation orientation (or a traveling orientation during excavation). The excavation orientation is, for example, an orientation when starting the excavation of the excavation object, such as earth, or when traveling toward the excavation object (or an orientation suitable for starting excavation or traveling). In addition, an orientation of the bucket 12 with the teeth 12T being in contact with the road surface RS is referred to as a ground contact orientation as shown in FIG. 5. The wheel loader 1 starts the excavation of the excavation object located ahead by, for example, setting the bucket 12 in the excavation orientation (or an orientation in which the teeth 12T is lower than the road surface RS from the excavation orientation) and traveling in the front direction. It should be noted that, in the wheel loader 1, the excavation orientation can also be referred to as a horizontal orientation because a direction of the teeth is substantially horizontal to the road surface RS.

(Configuration of Control System)

Figure 6:
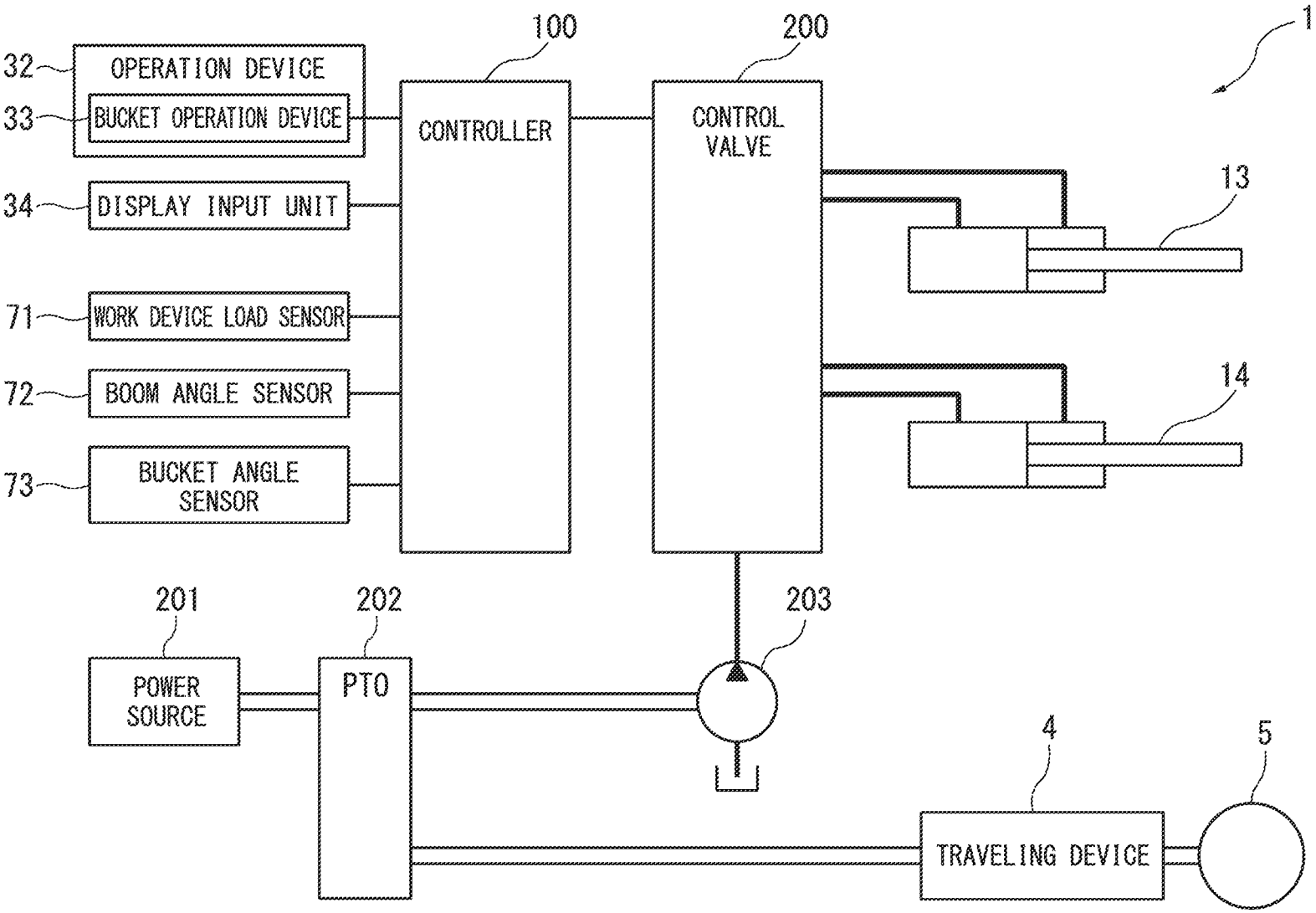
FIG. 6 is a block diagram showing a configuration example of a control system of the work machine according to the first embodiment.

FIG. 6 is a block diagram showing a configuration example of a control system of the wheel loader 1 according to the first embodiment. As shown in FIG. 6, the wheel loader 1 includes a power source 201, a power take off (PTO) 202, a hydraulic pump 203, a control valve 200, the operation device 32, the display input unit 34, and a controller 100.

The power source 201 generates a driving force for operating the work machine. Exemplary examples of the power source include an internal combustion engine or an electric motor.

The PTO 202 transmits at least a part of the driving force of the power source 201 to the hydraulic pump 203. The PTO 202 distributes the driving force of the power source 201 to the traveling device 4 and the hydraulic pump 203.

The hydraulic pump 203 is driven by the power source 201, and discharges a working fluid. At least a part of the working fluid discharged from the hydraulic pump 203 is supplied to each of the boom cylinder 13 and the bucket cylinder 14 via the control valve 200. The control valve 200 controls a flow rate and a direction of the working fluid supplied from the hydraulic pump 203 to each of the boom cylinder 13 and the bucket cylinder 14. The work device 10 is operated by the working fluid from the hydraulic pump 203.

The operation device 32 is disposed inside the cab 3. The operation device 32 is operated by the operator. The operator operates the operation device 32 to adjust a traveling direction and a traveling speed of the wheel loader 1, switches between forward and rearward movement, and operates the work device 10. The operation device 32 includes, for example, a steering wheel, a shift lever, an accelerator pedal, a brake pedal, and a bucket operation device (example of a work tool operation device) 33 for operating the bucket 12 of the work device 10. The bucket operation device 33 outputs a command signal for operating the orientation of the bucket 12. The display input unit 34 is configured by a combination of an input device and a display device, an input display device, such as a touch panel, and the like. The operator uses the display input unit 34, for example, to set a storage value of a target position or a target orientation in control of the work device 10 which will be described below.

Figure 7:
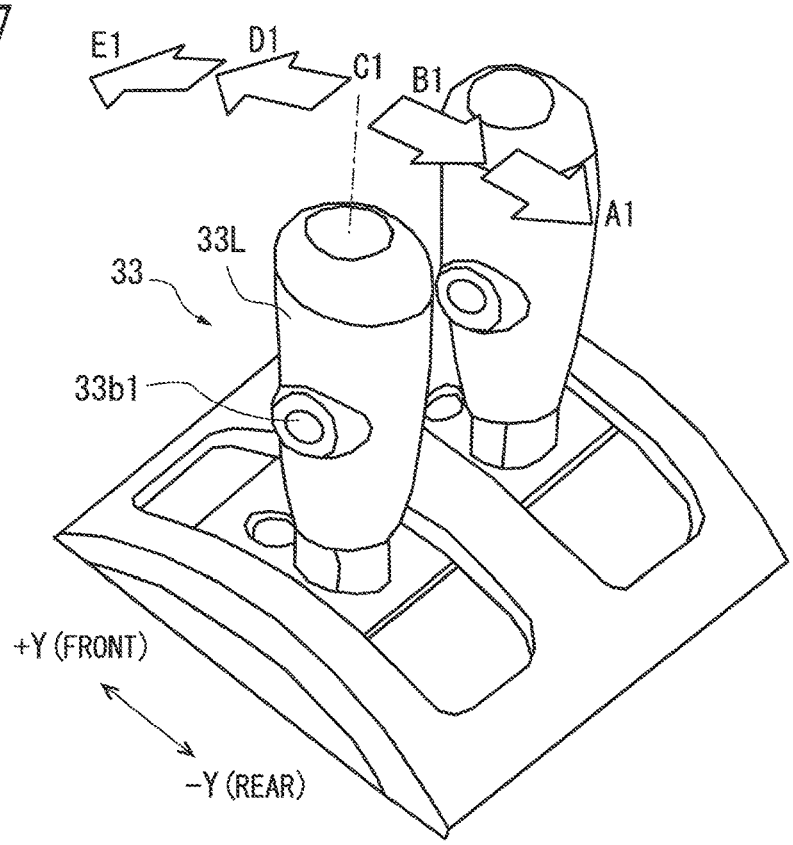
FIG. 7 is a perspective view showing a configuration example of a bucket operation device according to the first embodiment.
Figure 8:
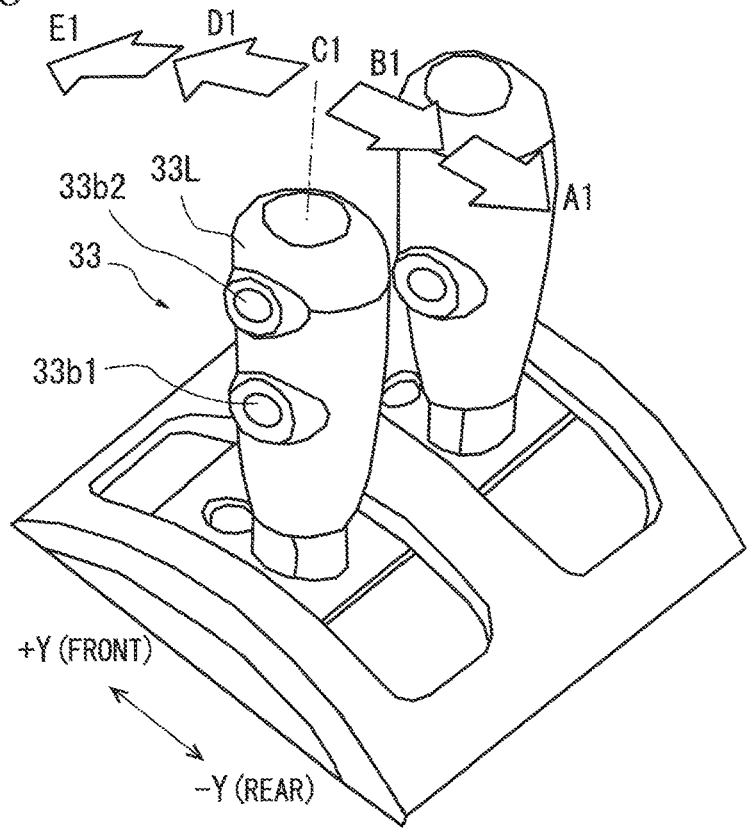
FIG. 8 is a perspective view showing another configuration example of the bucket operation device according to the first embodiment.

FIGS. 7 and 8 are configuration diagrams showing the bucket operation device 33 according to the first embodiment. It should be noted that FIG. 7 shows an example in which the bucket operation device 33 includes one switch 33*b*1 on an operation lever 33L, and FIG. 8 shows an example in which the bucket operation device 33 includes two switches 33*b*1 and 33*b*2 on an operation lever 33L. As shown in FIGS. 7 and 8, the bucket operation device 33 includes the operation lever 33L which is an electrical operation lever that can be operated in a direction of (E1←D1←C1→B1→A1) from a tilting position A1 (first control position) to a tilting position E1 (second control position) in the front-rear direction with respect to a neutral position (C1). The tilting positions A1 and E1 are positions at which, for example, the operation lever 33L has reached stroke ends in the rear direction and the front direction. The bucket operation device 33 has a mechanism that automatically returns the position of the operation lever 33L to the neutral position (C1) in a state in which the operation force equal to or greater than a certain level is not applied to the operation lever 33L. In the present embodiment, an operation of tilting the position of the operation lever 33L to the tilting position A1 or the tilting position E1 is referred to as a tilting hold operation. An operation of tilting the position of the operation lever 33L to the tilting position A1 is referred to as a tilt side tilting hold operation. An operation of tilting the position of the operation lever 33L to the tilting position E1 is also referred to as a dump side tilting hold operation.

The bucket operation device 33 outputs a control signal corresponding to a tilting direction and a tilting amount of the operation lever 33L. In addition, in a case in which the operation of tilting the operation lever 33L to the tilting positions A1 and E1 is performed, the bucket operation device 33 outputs a predetermined operation pattern signal indicating that the operation is performed. In addition, the bucket operation device 33 outputs a signal indicating whether or not the switch 33*b*1 or the switch 33*b*2 is pressed. In the present embodiment, an operation of pressing the switch 33*b*1 or the switch 33*b*2 may be the tilting hold operation. In this case, the bucket operation device 33 may be configured by using a pressure proportional control (PPC) valve.

It should be noted that, the bucket operation device 33 returns the operation lever to the neutral state (C1) in a case in which the operator's hand s separated from the operation lever 33L, but the controller 100 to be described below can perform control by assuming that a tilting hold state is virtually continued, for example, until the position or the orientation of the work device 10 is brought to a predetermined state.

In addition, the wheel loader 1 includes a work device load sensor 71, a boom angle sensor 72, and a bucket angle sensor 73.

The work device load sensor 71 detects a load applied to the work device 10. The work device load sensor 71 is, for example, a load measurement device, such as a strain gauge or a load cell, disposed in at least a part of the work device 10. Load data detected by the work device load sensor 71 is output to the controller 100. It should be noted that the load applied to the work device 10 may be detected by using, for example, a hydraulic pressure sensor that detects a pressure of a pressure oil for driving the boom cylinder 13, or a hydraulic pressure sensor that detects a pressure of a pressure oil for driving the bucket cylinder 14. In this case, the load applied to the work device 10 is changed between a state in which the excavation material is held in the bucket 12 and a state in which the excavation material is not held. The work device load sensor 71 can detect the presence or absence of the excavation material held in the bucket 12 by detecting the change in the load applied to the work device 10.

The boom angle sensor 72 detects an angle of the boom 11 with respect to the vehicle body 2, and outputs the detection data to the controller 100. The boom angle sensor 72 is, for example, an angle sensor disposed at a connection portion between the vehicle body 2 and the boom 11. It should be noted that the angle of the boom 11 may be calculated from a stroke amount of the boom cylinder 13.

The bucket angle sensor 73 is a sensor for detecting an angle of the bucket 12. The bucket angle sensor 73 is, for example, an angle sensor disposed at a connection portion between the boom 11 and the bell crank 15. The bucket angle sensor 73 detects an angle of the bell crank 15 with respect to the boom 11, and outputs detection data to the controller 100. The angle of the bucket 12 with respect to the boom 11 (and the vehicle body 2) can be calculated based on the angle of the boom 11 with respect to the vehicle body 2 detected by the boom angle sensor 72, and the angle of the bell crank 15 with respect to the boom 11 detected by the bucket angle sensor 73. It should be noted that the angle of the bucket 12 with respect to the boom 11 may be detected by using, for example, a sensor that detects the angle of the bucket 12 with respect to the boom 11 at the connection portion between the bucket 12 and the boom 11. In addition, the angle of the bell crank 15 with respect to the boom 11 or the angle of the bucket 12 with respect to the boom 11 may be calculated from the stroke amount of the boom cylinder 13 and a stroke amount of the bucket cylinder 14.

(Configuration of Controller)

Figure 9:
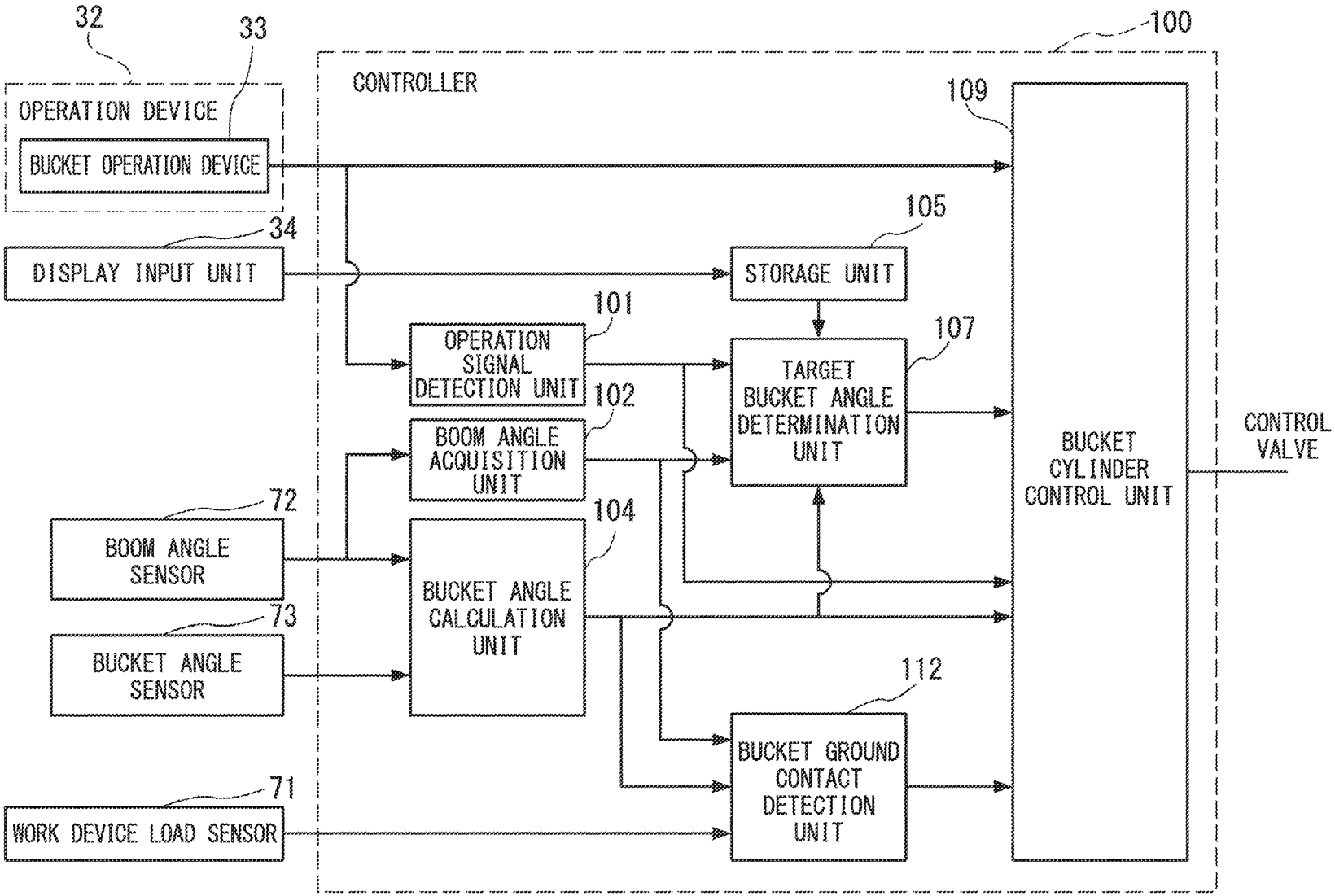
FIG. 9 is a schematic block diagram showing a configuration of a controller according to the first embodiment.

FIG. 9 is a configuration diagram showing the controller 100 of the wheel loader 1 according to the first embodiment. The controller 100 is configured by using, for example, a field programmable gate array (FPGA) or a microcomputer having a processor, a main storage device, an auxiliary storage device, an input/output device, and the like. The controller 100 includes an operation signal detection unit 101, a boom angle acquisition unit 102, a bucket angle calculation unit 104, a storage unit 105, a target bucket angle determination unit 107, a bucket ground contact detection unit 112, and a bucket cylinder control unit 109, as a functional configuration composed of hardware or a combination of hardware and software, such as a program.

The controller 100 according to the present embodiment is a device that controls the work device 10 including the bucket 12 and the movable support section 17 that changes the position and the orientation of the bucket 12. Then, the controller 100 selects any one of the at least three types of target orientations based on the command signal for operating the orientation of the bucket 12 and a detection signal indicating a current orientation of the bucket 12, and sets the selected target orientation as the target orientation of the bucket 12 to control the movable support section 17. The command signal for operating the orientation of the bucket 12 includes a control signal corresponding to the tilting direction and the tilting amount of the operation lever 33L output by the bucket operation device 33, and a control signal indicating that the tilting hold operation is performed with respect to the bucket operation device 33 output by the operation signal detection unit 101. The detection signal indicating the current orientation of the bucket 12 is a detection signal indicating a current bucket angle output by the bucket angle calculation unit 104.

It should be noted that, among a plurality of functions of the controller 100, FIG. 9 shows only a configuration corresponding to the control of the operation device 32 (operation unit) according to the operation of the bucket operation device 33. In addition, in an operation example of the controller 100, which will be described below, a case will be described in which, in the control according to the operation of the bucket operation device 33, the tilting hold operation is performed with respect to the operation lever 33L of the bucket operation device 33 shown in FIGS. 7 and 8.

The operation signal detection unit 101 receives an operation signal of the bucket operation device 33 in the operation device 32, and outputs, as the control signal indicating that the tilting hold operation is performed, a result of detecting whether or not the tilting hold operation of tilting the position of the operation lever 33L to the tilting position A1 or the tilting position E1, or whether or not the tilting hold operation is performed with respect to the switch **33*b*1 to the target bucket angle determination unit 107 and the bucket cylinder control unit 109. It should be noted that, in the present embodiment, the command signal for operating the orientation of the bucket 12 includes a first command signal and a second command signal which are described below and output by the operation signal detection unit 101**.

The first command signal is, for example, a signal output in a case in which the tilting hold operation to the tilting position A1 (first control position) is performed with respect to the operation lever 33L. The second command signal is, for example, a signal output in a case in which the tilting hold operation to the tilting position E1 (second control position) is performed with respect to the operation lever 33L.

Alternatively, the first command signal is, for example, a signal output in a case in which the operation lever 33L is operated to the tilting position B1 (direction of the first control position) and the switch **33*b*1 is operated. The second command signal is, for example, a signal output in a case in which the operation lever 33L is operated to the tilting position D1 (direction of the second control position) and the switch 33*b*1** is operated.

Alternatively, the first command signal is, for example, a signal that is output in a case in which the switch **33*b*1 (first switch) is operated. The second command signal is a signal output in a case in which the switch 33*b*2** (second switch) is operated.

The boom angle acquisition unit 102 receives the data detected by the boom angle sensor 72 to acquire a current boom angle. The boom angle acquisition unit 102 outputs the acquired current boom angle data to the target bucket angle determination unit 107 and the bucket ground contact detection unit 112. The current boom angle data may be, for example, data indicating a current boom cylinder length.

The bucket angle calculation unit 104 receives the data detected by the boom angle sensor 72 and the data detected by the bucket angle sensor 73 to calculate the current bucket angle. The bucket angle calculation unit 104 outputs the calculated current bucket angle data to the target bucket angle determination unit 107, the bucket cylinder control unit 109, and the bucket ground contact detection unit 112. The current bucket angle data may be, for example, data indicating a current bucket cylinder length.

The storage unit 105 stores, as the storage value, setting values of the at least three types of target orientations of the bucket 12 set by using the display input unit 34. In the present embodiment, the at least three types of target orientations include a first orientation, a second orientation, and a third orientation. Alternatively, in the second embodiment described below, at least three types of target orientations include the first orientation. In addition, an initial value of the first orientation can be, for example, a horizontal orientation of the bucket 12. In addition, an initial value of the second orientation can be, for example, a transport orientation of the bucket 12. In addition, an initial value of the third orientation can be, for example, a dumping orientation or a ground contact orientation of the bucket 12. The operator can change or initialize the setting values of the target orientations by using the display input unit 34.

The target bucket angle determination unit 107 selects one target orientation from among the setting values of the at least three types of target orientations stored in the storage unit 105 based on the output signal of the operation signal detection unit 101, the output signal of the bucket angle calculation unit 104, and the setting values of the target orientations set in the storage unit 105. The target bucket angle determination unit 107 determines a target bucket angle based on the selected target orientation and the output signal (boom angle) of the boom angle acquisition unit 102. Since a movable region of the orientation of the bucket 12 is changed according to the angle (boom angle) of the boom 11, the orientation of the bucket 12 is determined based on the target orientation and the boom angle. It should be noted that the data indicating the target bucket angle may be, for example, data indicating a target bucket cylinder length which is a target value of the bucket cylinder length. The target bucket angle determination unit 107 outputs the selected target orientation data to the bucket cylinder control unit 109. The target bucket angle determination unit 107 outputs the determined target bucket angle to the bucket cylinder control unit 109.

It should be noted that, in a case in which the first command signal is received from the operation signal detection unit 101, the target bucket angle determination unit 107 selects any one of the first orientation and the second orientation as the target orientation. In addition, in a case in which the second command signal is received from the operation signal detection unit 101, the target bucket angle determination unit 107 selects any one of the first orientation and the third orientation as the target orientation.

It should be noted that, in the present embodiment, the bucket 12 is rotationally movable between a first orientation region and a second orientation region. The first orientation region is an orientation region between the first orientation and the second orientation, and the second orientation region is an orientation region between the first orientation and the third orientation. In a case in which the first command signal is received from the operation signal detection unit 101 and the current orientation of the bucket 12 is the second orientation region, the target bucket angle determination unit 107 selects the first orientation as the target orientation. In addition, in a case in which the second command signal is received from the operation signal detection unit 101 and the current orientation of the bucket 12 is the first orientation region, the target bucket angle determination unit 107 selects the first orientation as the target orientation.

The bucket ground contact detection unit 112 detects whether or not the bucket 12 is in contact with the road surface (ground) RS based on the boom angle output by the boom angle acquisition unit 102, the bucket angle calculated by the bucket angle calculation unit 104, and the load of the work device 10 detected by the work device load sensor 71. For example, the bucket ground contact detection unit 112 estimates an interval between the bucket 12 and the road surface RS based on the boom angle and the bucket angle, and detects that the bucket 12 is in contact with the ground in a case in which the work device load sensor 71 detects a certain increase in the load. The bucket ground contact detection unit 112 outputs the detection result to the bucket cylinder control unit 109.

In a case in which a predetermined tilting hold operation is performed with respect to the bucket operation device 33, the bucket cylinder control unit 109 outputs the bucket cylinder command such that the target orientation selected by the target bucket angle determination unit 107 is obtained, based on the command signal for operating the orientation of the bucket 12 and the detection signal indicating the current orientation of the bucket 12. The bucket cylinder control unit compares the current bucket angle calculated by the bucket angle calculation unit 104 with the target bucket angle determined by the target bucket angle determination unit 107, and outputs the bucket cylinder command such that the current bucket angle is the target bucket angle. The bucket cylinder control unit 109 outputs the bucket cylinder command to control the control valve 200. The control valve 200 drives the bucket cylinder 14 based on the bucket cylinder command to control the movable support section 17.

(Operation Example of Bucket)

Figure 10:
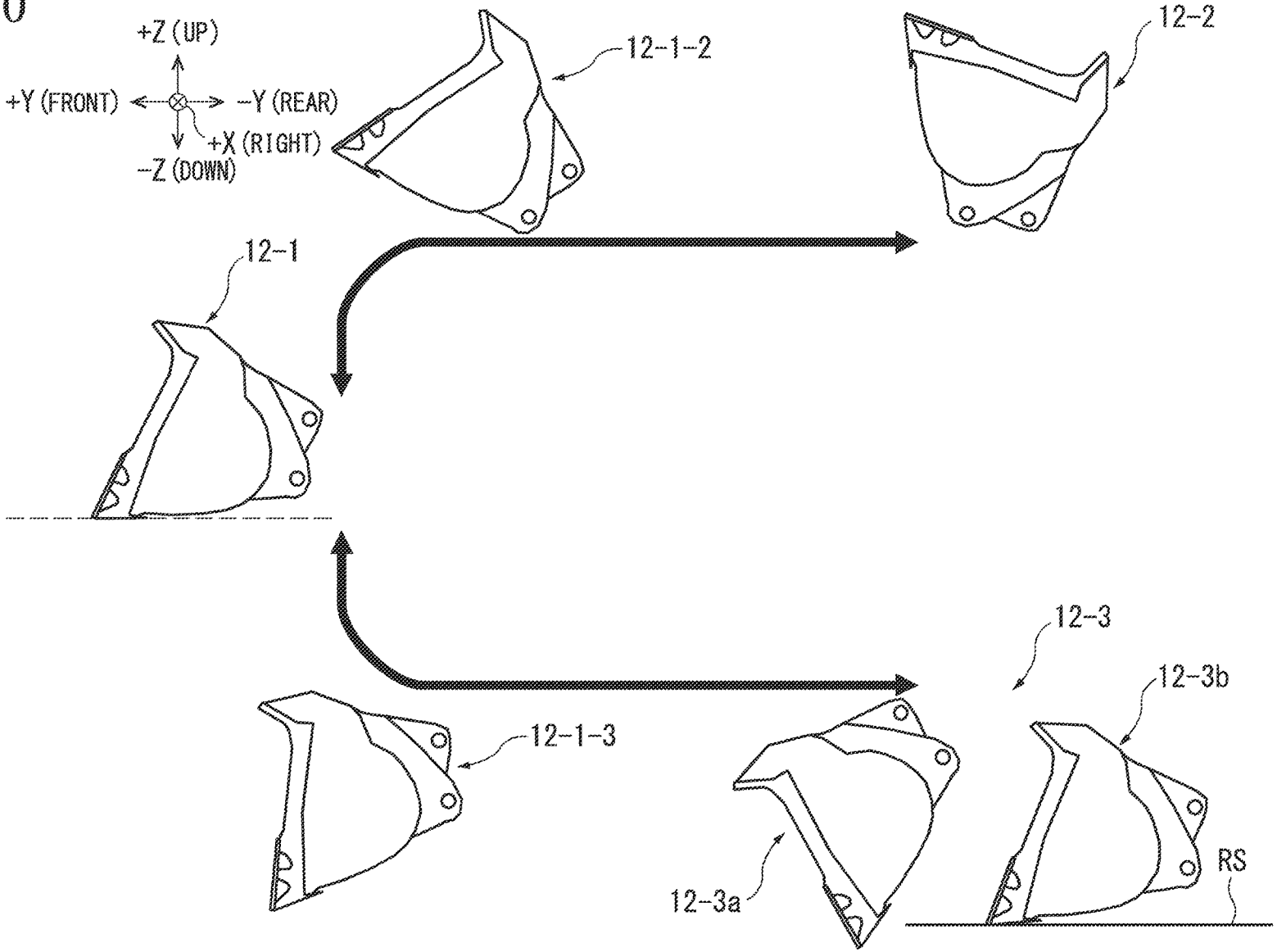
FIG. 10 is a schematic diagram showing an operation example of the bucket according to the first embodiment.

FIG. 10 is a schematic diagram showing an operation example of the bucket 12 according to the first embodiment. FIG. 10 shows a case in which the bucket 12 is in a horizontal state (horizontal orientation) as a bucket 12-1. A state in which the bucket 12 is tilted to the maximum extent (this state is referred to as a tilt end) is shown as a bucket 12-2. A state in which the bucket 12 is dumped to the maximum extent (this state is referred to as a dump end) is shown as a bucket 12-3. The orientation of the dump end is an orientation in any one of a state in which the bucket 12 is dumped to the maximum extent (shown as a bucket 12-3*a*) and a state in which the bucket 12 is in contact with the ground (shown as a bucket 12-3*b*).

It should be noted that, in the following description of the operation example, a case will be described in which the first orientation is the horizontal orientation, the second orientation is the tilt end, and the third orientation is the dump end. It should be noted that a bucket 12-1-2 is in an orientation between the bucket 12-1 in the first orientation and the bucket 12-2 in the second orientation. A bucket 12-1-3 is in an orientation between the bucket 12-1 in the first orientation and the bucket 12-3 in the third orientation.

(Operation Example of Controller)

Figure 11:
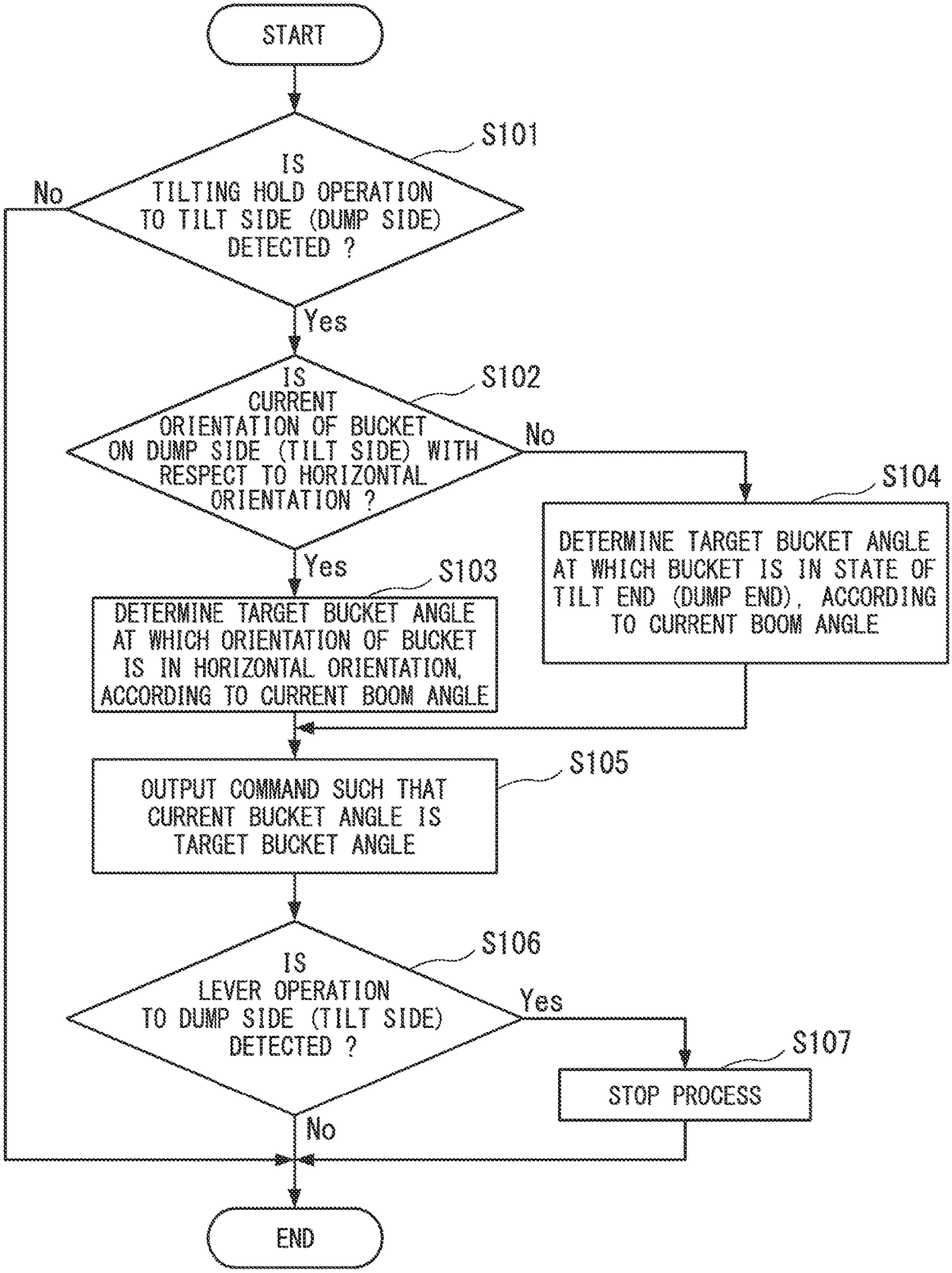
FIG. 11 is a flowchart showing an operation example of the controller according to the first embodiment.

FIG. 11 is a flowchart showing the operation example of the controller 100 according to the first embodiment. The controller 100 (bucket cylinder control unit 109) controls the bucket orientation by the process shown in FIG. 11.

FIG. 11 is a flow repeatedly executed at a predetermined cycle. It should be noted that FIG. 11 shows the process on the tilt side, which is a process in which "tilt side" or "tilt end" is read as "(dump side)" or "(dump end)" in "( )" in a case of the process on the dump side.

In the process shown in FIG. 11, the controller 100 first determines whether or not the tilting hold operation to the tilt side (dump side) is detected (S101). In a case in which the tilting hold operation is not detected (S101: No), the controller 100 terminates the process shown in FIG. 11. In a case in which the tilting hold operation is detected (S101: Yes), the controller 100 determines whether or not the current orientation of the bucket 12 is on the dump side (tilt side) with respect to the horizontal orientation based on the current bucket angle data (S102). In a case in which the current orientation of the bucket 12 is on the dump side (tilt side) with respect to the horizontal orientation (S102: Yes), the controller 100 determines the target bucket angle at which the bucket 12 is in the horizontal orientation, according to the current boom angle (S103). In a case in which the current orientation of the bucket 12 is not on the dump side (tilt side) with respect to the horizontal orientation (S102: No), the controller 100 determines the target bucket angle at which the orientation of the bucket 12 is in a state of the tilt end (dump end), according to the current boom angle (S104). Next, the controller 100 outputs the command such that the current bucket angle is the target bucket angle (S105). Next, the controller 100 determines whether or not the lever operation to the dump side (tilt side) is detected (S106). In a case in which the lever operation to the dump side (tilt side) is detected (S106: Yes), the controller 100 stops the process (S107). In a case in which the lever operation to the dump side (tilt side) is not detected (S106: No), the controller 100 terminates the process shown in FIG. 11.

Through the process described above, the controller 100 controls the movable support section 17 such that the orientation of the bucket 12 is the target bucket orientation. In the present embodiment, in a case in which the bucket orientation is on the dump side (tilt side) with respect to the horizontal orientation (first orientation), the orientation of the bucket can be adjusted to the horizontal orientation (first orientation) by the tilt side (dump side) tilting hold operation.

In addition, in a case in which the bucket orientation is on the tilt side (dump side) with respect to the horizontal orientation (first orientation), the controller 100 can adjust the tilt end (dump end) by the tilt side (dump side) tilting hold operation.

Actions/Effects

As described above, according to the present embodiment, the orientation of the work tool can be automatically adjusted to the plurality of orientations by performing the predetermined tilting hold operation with respect to the bucket operation device 33.

Second Embodiment

Next, an operation example of the controller 100 according to a second embodiment will be described in detail with reference to FIGS. 12 to 14. It should be noted that, since the configuration of the controller 100 is the same as the first embodiment shown in FIG. 9, the description thereof will be omitted.

(Operation Example of Controller)

Figure 12:
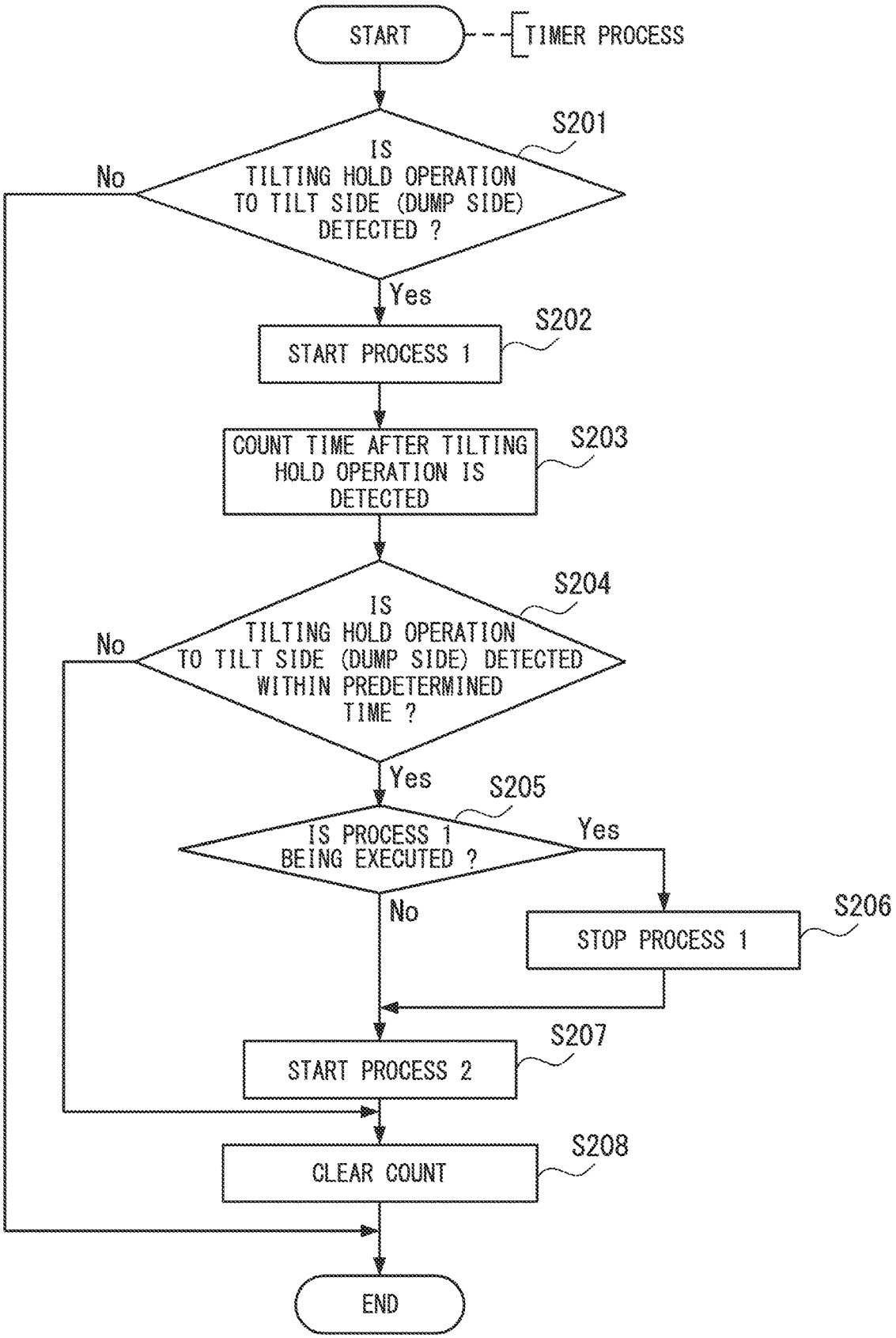
FIG. 12 is a flowchart showing an operation example of a controller according to a second embodiment.
Figure 13:
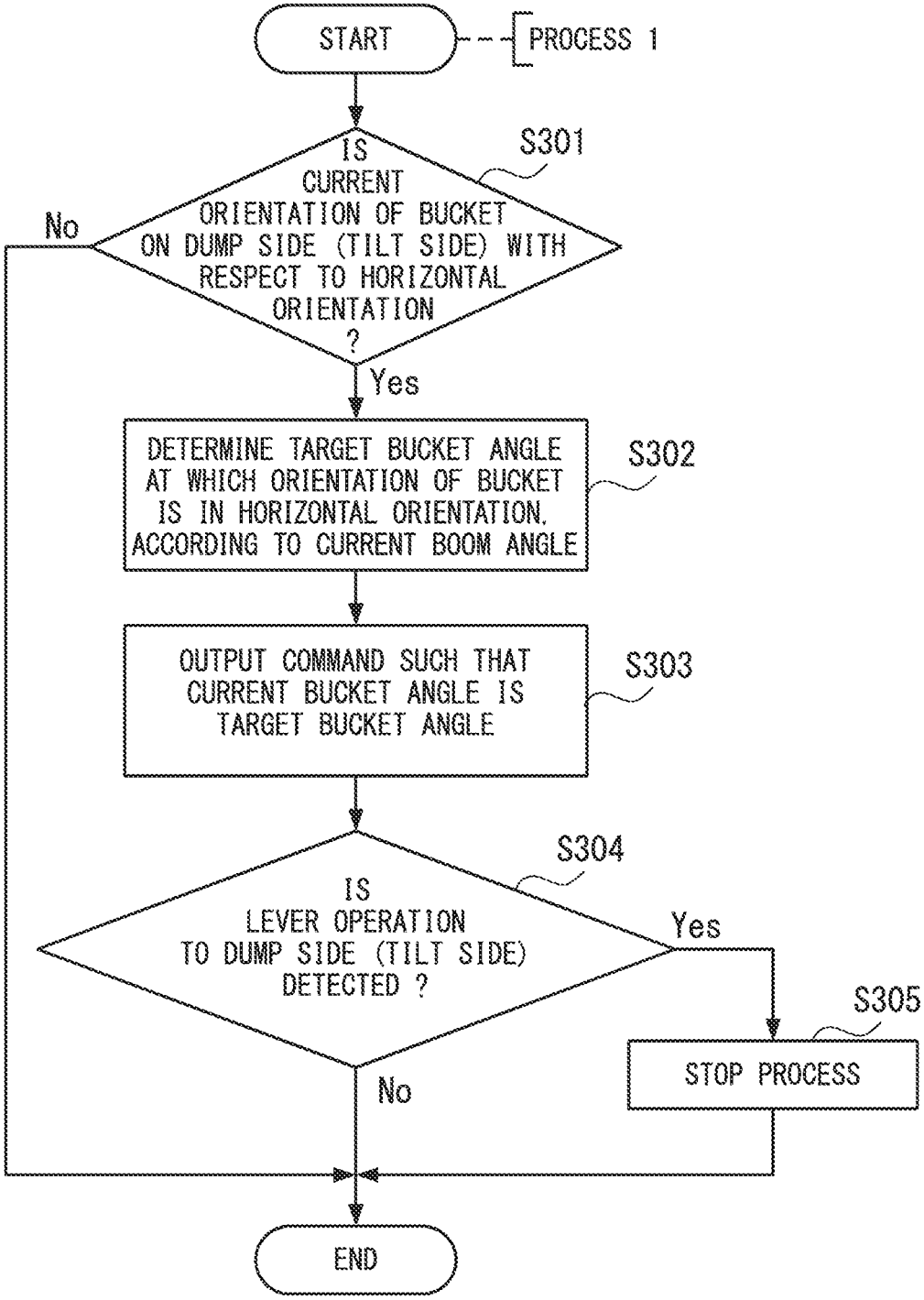
FIG. 13 is a flowchart showing the operation example of the controller according to the second embodiment.
Figure 14:
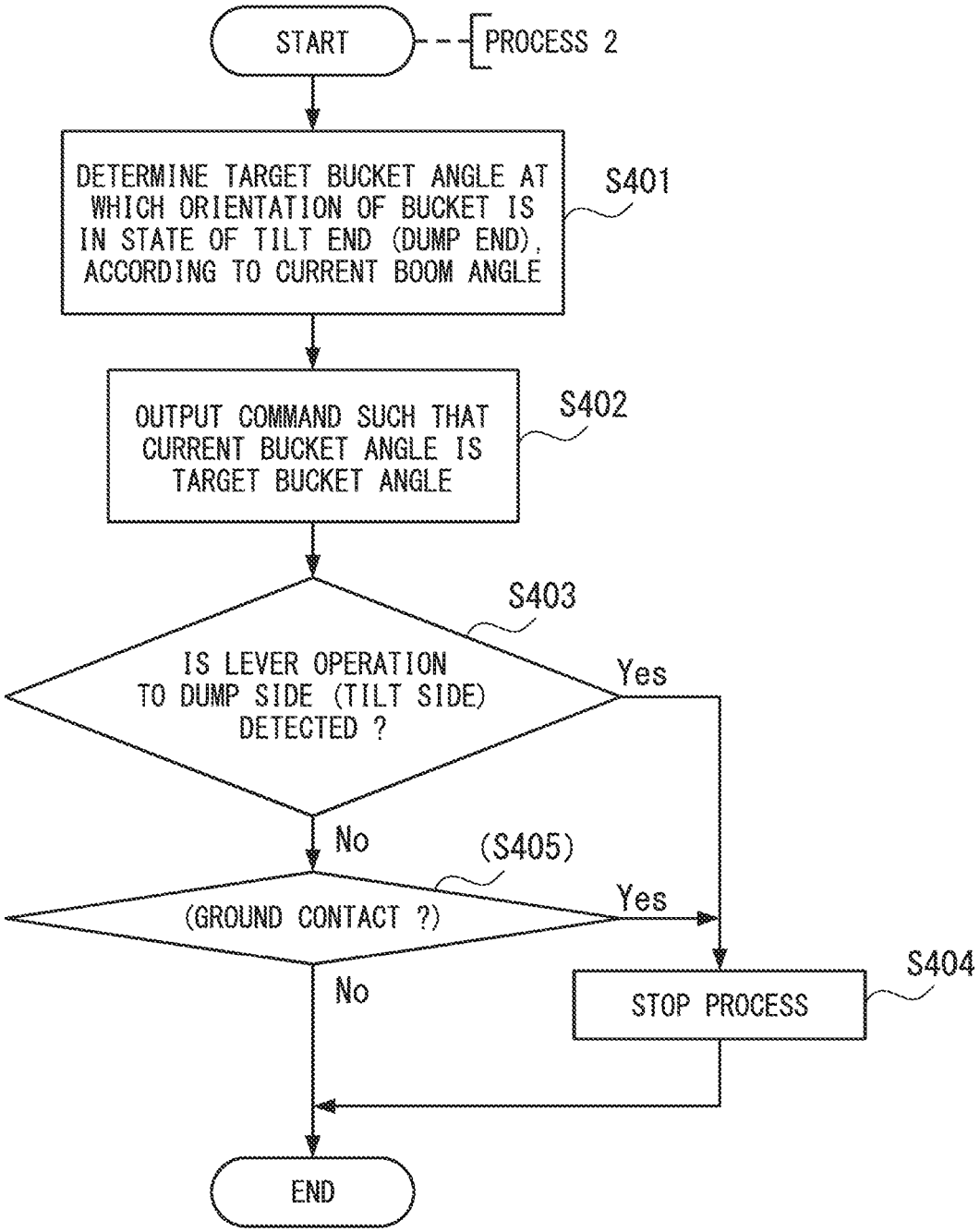
FIG. 14 is a flowchart showing the operation example of the controller according to the second embodiment.

FIGS. 12 to 14 are flowcharts showing the operation examples of the controller 100 according to the second embodiment. The controller 100 (bucket cylinder control unit 109) controls the bucket orientation by the processes shown in FIGS. 12 to 14.

FIG. 12 shows a main flow repeatedly executed at a predetermined cycle. FIG. 13 shows contents of a process 1 (process in a case in which the tilting hold operation is detected once) executed in S202 and stopped in S206. FIG. 14 shows contents of a process 2 (for example, a process in a case in which a second tilting hold operation is detected within a predetermined time after a first tilting hold operation is detected) executed in S207. It should be noted that FIGS. 12 to 14 show the processes on the tilt side, which is a process in which "tilt side" or "tilt end" is read as "(dump side)" or "(dump end)" in "( )" and the determination of (S405) is added in a case of the dump side process. There is no problem even in a case in which the process of the determination in S405 is executed by the process on the tilt side.

In the process shown in FIG. 12, the controller 100 first determines whether or not the tilting hold operation to the tilt side (dump side) is detected (S201). In a case in which the tilting hold operation is not detected (S201: No), the controller 100 terminates the process shown in FIG. 12. In a case in which the tilting hold operation is detected (S201: Yes), the controller 100 starts the process 1 (FIG. 13) (S202). Thereafter, the process 1 is executed until the process 1 is stopped in the process 1 or is stopped in the process S206.

In process 1 shown in FIG. 13, the controller 100 first determines whether or not the current orientation of the bucket 12 is on the dump side (tilt side) with respect to the horizontal orientation based on the current bucket angle data (S301). In a case in which the current orientation of the bucket 12 is not on the dump side (tilt side) with respect to the horizontal orientation (S301: No), the controller 100 terminates the process 1 shown in FIG. 13. In a case in which the current orientation of the bucket 12 is on the dump side (tilt side) with respect to the horizontal orientation (S301: Yes), the controller 100 determines the target bucket angle at which the orientation of the bucket 12 is in the horizontal orientation, according to the current boom angle (S302). Next, the controller 100 outputs the command such that the current bucket angle is the target bucket angle (S303). Next, the controller 100 determines whether or not the lever operation to the dump side (tilt side) is detected (S304). In a case in which the lever operation to the dump side (tilt side) is detected (S304: Yes), the controller 100 stops the process (S304), and in a case in which the lever operation to the dump side (tilt side) is detected (S304: No), the controller 100 terminates the process 1 shown in FIG. 13.

On the other hand, in the process shown in FIG. 12, the controller 100 starts the process 1 (FIG. 13) (S202), and then counts time after the tilting hold operation is detected (S203). Next, the controller 100 determines whether or not the tilting hold operation to the tilt side (dump side) is detected within a predetermined time (S204). In a case in which the tilting hold operation to the tilt side (dump side) is not detected within the predetermined time (S204: No), the controller 100 clears the counter (S208), and terminates the process shown in FIG. 12. In a case in which the tilting hold operation to the tilt side (dump side) is detected within the predetermined time (S204: Yes), the controller 100 determines whether or not the process 1 is being executed (S205). In a case in which process 1 is being executed (S205: Yes), the controller 100 stops the process 1 (S206). In a case in which process 1 is not being executed (S205: No) or in a case in which the process 1 is stopped (S206), the controller 100 starts the process 2 (FIG. 14) (S207), clears the count (S208), and terminates the process shown in FIG. 12.

In the process 2 shown in FIG. 14, the controller 100 first determines the target bucket angle at which the orientation of the bucket 12 is in a state of the tilt end (dump end), according to the current boom angle (S401). Next, the controller 100 outputs the command such that the current bucket angle is the target bucket angle (S402). Next, the controller 100 determines whether or not the lever operation to the dump side (tilt side) is detected (S403). In a case in which the lever operation to the dump side (tilt side) is detected (S403: Yes), the controller 100 stops the process (S404). On the other hand, in a case in which the lever operation to the dump side (tilt side) is not detected (S403: No), the controller 100 determines whether or not the ground contact of the bucket 12 is detected (S405). In a case in which the ground contact of the bucket 12 is detected (S405: Yes), the controller 100 stops the process (S404), and in a case in which the ground contact of the bucket 12 is not detected (S405: No), the controller 100 terminates the process shown in FIG. 14.

Through the process described above, in a case in which the bucket 12 is in the second orientation or the orientation between the first orientation and the second orientation, when the dump side tilting hold operation is performed once, the controller 100 adjusts the bucket 12 to the first orientation (horizontal orientation). In addition, in a case in which the bucket 12 is in the third orientation or the orientation between the first orientation and the third orientation, when the tilt side tilting hold operation is performed once, the controller 100 adjusts the bucket 12 to the first orientation (horizontal orientation).

In a case in which the bucket 12 is in any orientation, when the tilt side tilting hold operation is continuously and repeatedly performed within the predetermined time, the controller 100 adjusts the bucket 12 to the second orientation (tilt end). In addition, in a case in which the bucket 12 is in any orientation, when the dump side tilting hold operation is continuously and repeatedly performed within the predetermined time, the controller 100 adjusts the bucket 12 to the third orientation (dump end).

Actions/Effects

As described above, with the controller 100 according to the second embodiment, in a case in which the command signal for operating the orientation of the bucket 12 is received, the target bucket angle determination unit 107 of the controller 100 sets the first orientation as the target orientation of the bucket 12 to control the movable support section 17. In addition, in a case in which the command signal indicating the current orientation of the bucket 12 is continuously and repeatedly received within the predetermined time, the controller 100 selects a target orientation different from the first orientation among the at least three types of target orientations, and sets the selected target orientation as the target orientation of the bucket 12 to control the movable support section 17.

In a case in which the first command signal is continuously and repeatedly received from the operation signal detection unit 101 within the predetermined time, the target bucket angle determination unit 107 selects the second orientation from among the setting values of the at least three types of target orientations stored in the storage unit 105 as the target orientation, and sets the selected target orientation as the target orientation of the bucket 12 to control the movable support section 17. In addition, in a case in which the second command signal is continuously and repeatedly received from the operation signal detection unit 101 within the predetermined time, the target bucket angle determination unit 107 selects the third orientation from among the setting values of the at least three types of target orientations stored in the storage unit 105 as the target orientation, and sets the selected target orientation as the target orientation of the bucket 12 to control the movable support section 17.

According to the present embodiment, the orientation of the work tool can be automatically adjusted to the plurality of orientations by performing the predetermined tilting hold operation with respect to the bucket operation device 33.

Modification Example or Other Embodiments of Present Embodiment

Hereinbefore, the embodiments of the present invention are described with reference to the drawings, but the specific configuration is not limited to the embodiments described above, and includes design changes and the like without departing from the gist of the present invention.

For example, the wheel loader 1 may be remotely operable. In this case, a part or all of the controller 100 and the operation device 32 can be provided, for example, at a place in which the remote operation is performed.

In addition, for example, the work machine (or work vehicle) is not limited to the wheel loader, and can be another work machine, such as a hydraulic excavator including a work device having a work tool and a movable support section of the work tool. In addition, the work tool is not limited to the bucket. The work tool may be, for example, a fork, a bale grab, or the like that is attached to the wheel loader to be replaceable, as an attachment.

In addition, a part or all of a program executed by a computer in the embodiments described above can be distributed via a computer-readable recording medium or a communication line.

According to each of the aspects of the present invention, it is possible to automatically adjust the orientation of the work tool to the plurality of orientations.

What is claimed is:

1. A control system of a work machine including a work device including a work tool and a movable support section configured to change an orientation of the work tool, the control system comprising:

a controller including a storage unit configured to store at least three types of target orientations including a first orientation and a second orientation, or a third orientation, the controller being configured to control the movable support section by using the first orientation as a target orientation of the work tool in response to a first receipt of a first command signal or a second command signal for operating the orientation of the work tool, and in a case of a second receipt of the first command signal after the first receipt of the first command signal, determine the second orientation as the target orientation of the work tool, or in a case of a second receipt of the second command signal after the first receipt of the second command signal, determine the third orientation as the target orientation of the work tool, and the controller being configured to control the movable support section based on the determined target orientation.

2. The control system according to claim 1, wherein the work tool is rotationally movable between a first orientation region and a second orientation region, the first orientation region is an orientation region between the first orientation and the second orientation, the second orientation region is an orientation region between the first orientation and the third orientation, and the controller is configured to in a case in which the first command signal is received and the current orientation of the work tool is in the second orientation region, select the first orientation as the target orientation, and in a case in which the second command signal is received and the current orientation of the work tool is in the first orientation region, select the first orientation as the target orientation.

3. The control system according to claim 1, wherein the first orientation is a horizontal orientation of the work tool, the second orientation is a transport orientation of the work tool, and the third orientation is a dumping orientation of the work tool or a ground contact orientation of the work tool.

4. The control system according to claim 1, wherein a work tool operation device configured to output the command signal is a lever operable between a first control position and a second control position, the first command signal is a signal output in a case in which the lever is operated to the first control position, and the second command signal is a signal output in a case in which the lever is operated to the second control position.

5. The control system according to claim 1, wherein a work tool operation device configured to output the command signal includes a lever operable between a first control position and a second control position and a switch, the first command signal is a signal output in a case in which the lever is operated in a direction of the first control position and the switch is operated, and the second command signal is a signal output in a case in which the lever is operated in a direction of the second control position and the switch is operated.

6. The control system according to claim 1, wherein a work tool operation device configured to output the command signal includes a first switch and a second switch, the first command signal is a signal output in a case in which the first switch is operated, and the second command signal is a signal output in a case in which the second switch is operated.

7. A work machine comprising:

the control system according to claim 1.

* * * * *